US005687054A

United States Patent [19]

Takada et al.

[11] Patent Number: 5,687,054

[45] Date of Patent: Nov. 11, 1997

[54] CORONA CHARGING APPARATUS

[75] Inventors: Mikihiko Takada; Yukio Okamoto, both of Hachioji, Japan; Jeffrey L. Trask, Boise, Id.

[73] Assignees: Konica Corporation, Japan; Hewlett Packard Company

[21] Appl. No.: 670,395

[22] Filed: Jun. 25, 1996

[30] Foreign Application Priority Data

Mar. 8, 1996 [JP] Japan ..... 8-051310

[51] Int. Cl.[6] ..... G03G 21/00

[52] U.S. Cl. ..... 361/225; 399/100

[58] Field of Search ..... 361/225, 229, 361/230; 250/324; 15/1.51; 399/100, 170, 98–99, 343

[56] References Cited

U.S. PATENT DOCUMENTS

| | | | |
|---|---|---|---|
| 3,842,273 | 10/1974 | Van Buskirk | 399/100 |
| 3,875,407 | 4/1975 | Hayne | 399/100 |
| 3,978,379 | 8/1976 | DelVecchio | 39/170 |
| 5,089,850 | 2/1992 | Ogura et al. | 399/99 |
| 5,485,251 | 1/1996 | Kita et al. | 399/343 |
| 5,594,532 | 1/1997 | Tuvesson et al. | 399/100 |

*Primary Examiner*—Jeffrey A. Gaffin
*Assistant Examiner*—Michael J. Sherry
*Attorney, Agent, or Firm*—Jordan B. Bierman; Bierman, Muserlian and Lucas LLP

[57] ABSTRACT

Since the first cleaning member **24*g* scrapes off the foreign materials adhered to the corona charging electrode, and following that, the second cleaning member 24*h* wipes off the scraped foreign materials, the layered foreign materials firmly adhered on the corona charging electrode 22** is removed. Accordingly, image formation in electrophotographic apparatus or the like is suitably carried out, and image quality deterioration of the recorded image is suppressed.

7 Claims, 5 Drawing Sheets

CORONA CHARGING APPARATUS

BACKGROUND OF THE INVENTION

The present invention relates to a corona charging apparatus such as corotron, scorotron, etc., for use in electrophotographic apparatus or the like, and specifically to a cleaning technology to maintain charging characteristics of a corona charging electrode in a suitable condition.

Conventionally, in a corona charging apparatus, a problem exists in which foreign materials, such as toner powders and products such as (SiO2) generated by corona charge, adhere to the surface of a wire-like corona charging electrode, depending on use of the apparatus, and therefore the amount of ions generated from the corona charging electrode, is reduced, resulting in decreased charging function. Accordingly, in conventional technology, the following is carried out to prevent the occurrence of the above-described phenomena. That is, a felt-like pad or a brush-like cleaning member is provided in the charging apparatus, which is slid along the corona charging electrode, so that foreign materials such as powders or generated products is removed.

However, as the corona charge advances, specifically, products generated by the corona charge firmly adhere to the electrode surface in the form of layers. In this case, the foreign materials can not be removed by the conventional technology, and therefore the charge function is decreased. Due to this decrease, a charging apparatus of an electrophotographic apparatus in which the corona charge is used, does not function fully, and as a result, image defects such as white or black streaks and stripes, or defects such as uneven density of recorded images, occur.

SUMMARY OF THE INVENTION

The present invention is proposed in view of the conventional problems. An object of the present invention is to provide a corona charging apparatus by which foreign materials even firmly adhered on the corona charging electrode is removed, and image quality deterioration of a recorded image formed by an electrophotographic apparatus is suppressed.

Therefore, the present invention is structured as follows. A corona charging apparatus has a corona charging electrode stretched longitudinally in the apparatus, and a cleaning means for cleaning foreign materials adhered to the corona charging electrode. The corona charging apparatus comprises: the first cleaning means which slides longitudinally in the corona charging apparatus and which scrapes off the foreign materials; and the second cleaning means which slides longitudinally and wipes off any remaining foreign materials on the corona charging electrode, after the foreign materials has been scraped off by the first cleaning means.

According to the invention, since the first cleaning means scrapes off foreign materials adhered to the corona charging electrode, and following that, the second cleaning means wipes off the scraped foreign materials, any foreign materials firmly adhered and stratified on the corona charging electrode is removed. Therefore, image formation in the electrophotographic apparatus or the like, is suitably carried out and the image quality deterioration of the recorded image is prevented.

It is preferable that the first cleaning means is composed of glass-containing resin.

Due to the invention, glass material contained in resin material has the appropriate hardness, and the foreign materials adhered to the corona charging electrode can be effectively scraped off, and further, the cleaning means can be produced at a low cost.

It is preferable that the second cleaning means is formed of fiber or porous materials.

Due to the invention, the fine powdered foreign materials scraped by the first cleaning means is almost completely captured by the fiber or porous second cleaning means.

It is preferable that at least the fist cleaning means provided in the cleaning means is composed of a pair of cleaning members which are in pressure-contact with the corona charging electrode such that the members are opposed to each other at different positions on the longitudinal direction of the corona charging electrode.

Due to the invention, since the cleaning means is in pressure-contact with the corona charging electrode at different positions in the longitudinal direction, the cleaning member can be in pressure-contact with the corona charging electrode with the pressing force at any time even when the cleaning means for foreign materials is worn by use and a decrease of the cleaning function for foreign materials is prevented. Further, since the cleaning means are arranged opposite to each other with the corona charging electrode sandwiched between them, the cleaning means can clean different portions on both sides of the corona charging electrode surface.

It is preferable to provide an open means to release the corona dishcarging electrode from the pressure-contact condition by at least the first cleaning means which is provided in the cleaning means.

Due to the invention, since the pressure-contact condition of the cleaning means with respect to the corona charging electrode is opened by the open means except for the cleaning time period, the corona charging electrode is adjusted so as to surely locate at a predetermined position, without deviating from the position, and thus suitable charging functions can be secured.

It is preferable that the first cleaning means has an approximate V-shaped pressure-contact portion, and applies pressure-contact with the corona charging electrode at the valley portion of the V-shaped pressure-contact portion.

Due to the invention, since the position of the corona charging electrode is regulated by the pressure-contact portion of the first cleaning means, the tension of the stretched corona charging electrode is not changed by the cleaning operations, and therefore, damage or breakage of the corona charging electrode is prevented. Further, the contact surface of the pressure-contact portion of the first cleaning means with the corona charging electrode increases, as compared to a flat surface in contact with the corona charging electrode, resulting in an increase of the cleaning efficiency.

DETAILED DESCRIPTION OF THE INVENTION

Figure 1:
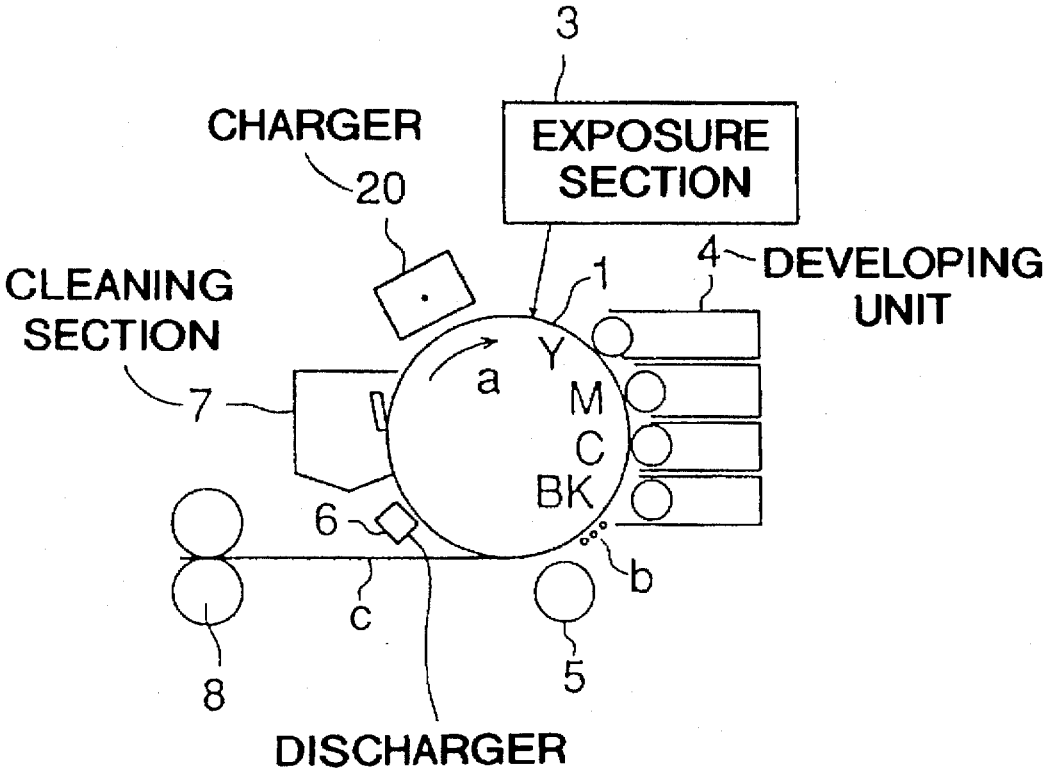
FIG. 1 is a view showing an outline structure of an electrophotographic type color printer in the present embodiment.

Referring to the drawings, an embodiment of the present invention will be described below.

FIG. 1 is a view showing the outline of the structure of an electrophotographic color printer. As shown in FIG. 1, the surface of a photoreceptor drum 1 rotating in the arrowed direction of an arrow mark "a" is charged by a charger 20 having a corona charge mechanism. An electrostatic latent image corresponding to Y (yellow) is formed on this surface by an exposure section 3. This latent image is developed by Y toner by a developing sleeve provided in a Y developing unit 4. A toner image "b" is obtained when the charger 20, the exposure section 3, and developing unit 4 are successively operated for M (magenta), C (cyan), and Bk (black) latent images stacking on the photoreceptor drum 1. The toner image "b" is transferred onto a transfer sheet "c" by a transfer roller 5, and the sheet "c" is separated from the photoreceptor drum 1 by a separation means such as a separation claw or a curvature separation means. A recorded image is obtained on the sheet "c" when toner is fixed by the fixing roller 8.

On the other hand, after the sheet "c" has been separated, unnecessary potential voltage on the photoreceptor drum 1 is discharged by a discharger 6, and any toner remaining on the surface of the photoreceptor drum 1 is removed by a cleaning section 7. The photoreceptor drum 1 is then ready for another cycle.

As described above, although the corona charger is used mainly for the charger of the photoreceptor drum, sometimes it can also be used as a transfer means, a discharging means or a separation means.

As described above, in this charger 20, foreign materials such as scattering toner in a color printer or generated matter (SiO2, etc.) by the corona charge, adheres to the surface of a wire-like corona charging electrode, resulting in reduced charge function of the charger 20. Due to this decrease of the function, image defects such as white or black streaks or stripes, or defects such as nonuniform density, etc., are generated on the recorded image.

Due to this reason, in the present invention, the cleaning section used for the corona charger is improved, and thereby, foreign materials firmly adhered to the surface of the charge electrode, which conventionally is not removed, can be removed.

Figure 2:
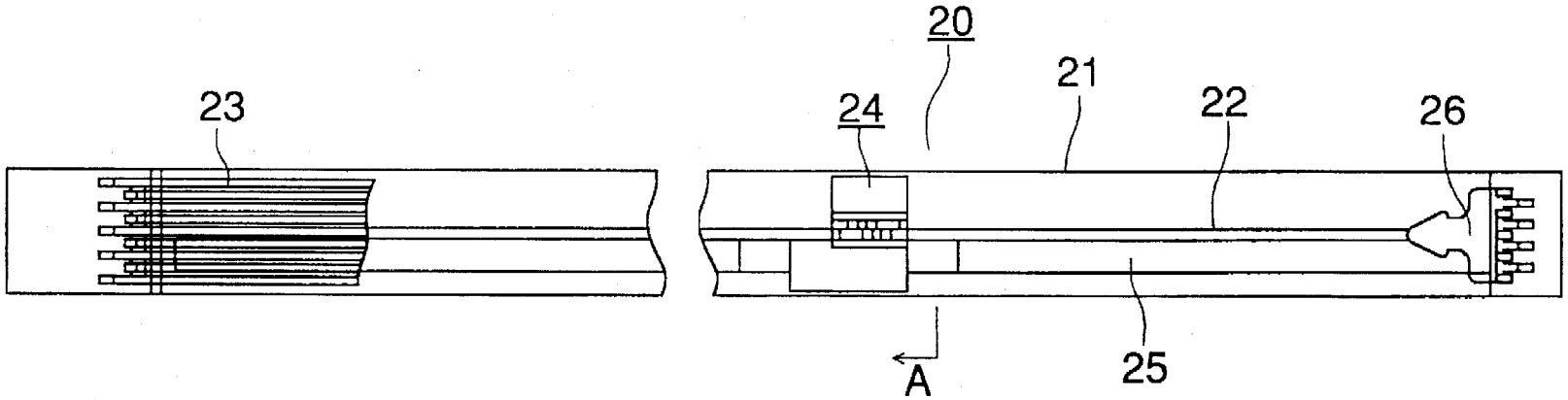
FIG. 2 is a plan view showing the outline of a charger in the present embodiment.
Figure 3:
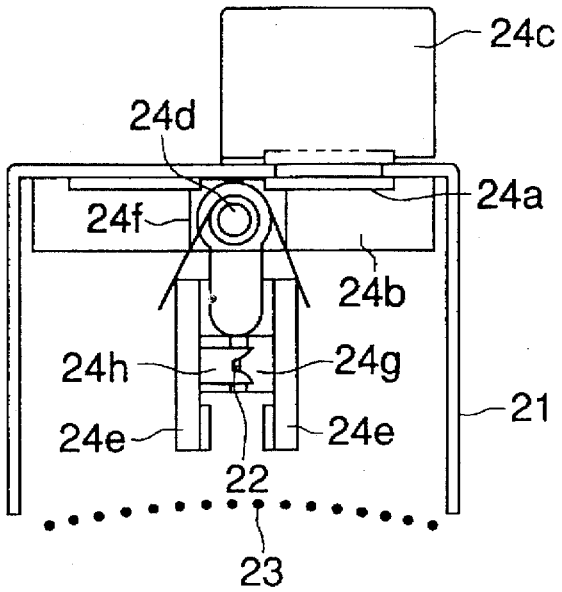
FIG. 3 is a view showing a detailed structure of a cleaning portion for a corona charging electrode in the present embodiment.
Figure 3:
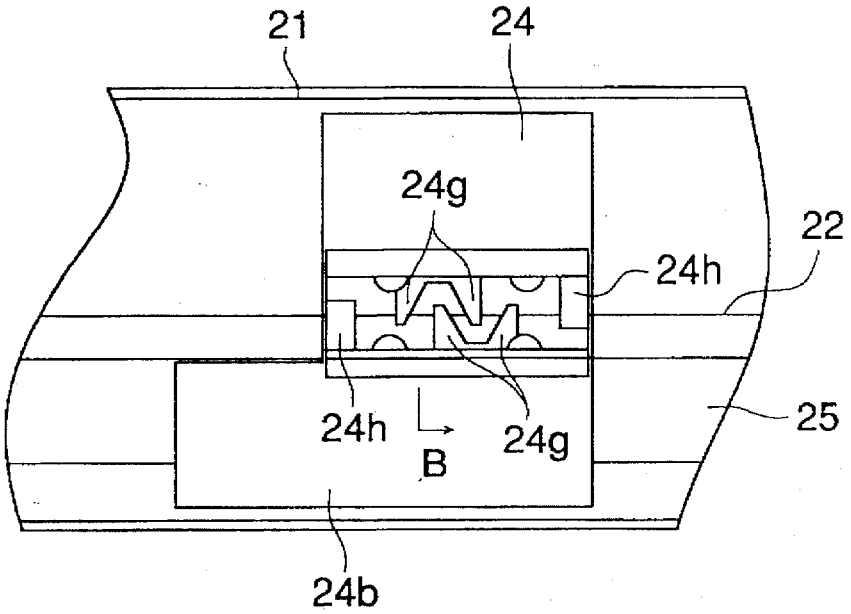

FIG. 2 is an outline plan view of the charger 20 viewed from the photoreceptor drum 1 side. FIG. 3 is a view showing detailed structure of the cleaning section of the corona charging electrode. FIG. 3(*a*) is a view, viewed from a letter A in FIG. 2.

The charger 20 has a box-shaped shield 21 which is open on the photoreceptor drum 1 side, one wire-like corona charging electrode 22 stretched within the shield 21, and a screen-like grid 23 provided on the open end side of the shield 21. The potential voltage of corona ions is modulated by the grid 23, thereby uniformly charging the surface of the photoreceptor drum 1.

A longitudinal slit 25 is provided in the bottom plate of the shield 21, and a leg portion 24*a* of a moving portion 24*b* penetrates the slit 25. The moving portion 24*b* is supported so that it can move along the slit 25 in the direction of the length of the shield 21. A knob portion 24*c* is fixed on the leg portion 24*a* opposed to the moving portion 24*b*, wherein the slit 25 is sandwiched between two leg portions 24*a* which are opposite to each other. Therefore, when the operators grip this knob portion 24*c* and move it longitudinally, the moving portion 24*b* can be moved in the desired direction in the charger 20. In this connection, in the present embodiment, the moving portion 24*b* is moved manually. However, it may also be automatically moved, for example, when a drive pulley around which a driving wire is wound, extending from both ends of the shield 21, is provided on the moving portion 24*b*, and the rotation of the drive pulley is reversed at both ends of the shield 21 by a limit switch, etc., so that the moving portion 24*b* reciprocates.

A pair of cleaning member holders 24*e* are provided rotatably around an axis 24*d* provided to the moving portion 24*b*. Tow pairs of the first cleaning members 24*g* and a pair of the second cleaning members 24*h* are provided on the pair of cleaning member holders 24*e* in the following arrangement. One pair of the two pairs of the first cleaning members 24*g* and one of the pair of the second cleaning members 24*h* are arranged opposite to the other one of the two pairs of the first cleaning members 24*g* and the other one of the pair of the second cleaning member so that the corona charging electrode 22 is sandwiched between one pair and the other pair of the two pairs of the first cleaning members 24*g* and between one and the other one of the pair of the second cleaning members 24*h*. A coil spring 24*f* is provided around the axis 24*d*, and each end of the coil spring 24*f* pushes each cleaning member holder 24*e* toward the corona charging electrode 22. Accordingly, the first cleaning members 24*g* and the second cleaning members 24*h* sandwich all outer peripheral surface of the corona charging electrode 22 due to pressure-contact with the electrode 22. Accordingly, when the moving portion 24*b* is slid along the corona charging electrode 22 by the operation of the knob portion 24*c*, all outer peripheral surface of the corona charging electrode 22 is cleaned longitudinally by the first cleaning member 24*g* and the second cleaning member 24*h*.

Next, the first cleaning member and the second cleaning member, respectively constituting the first cleaning means and the second cleaning means, will be detailed.

Figure 4:
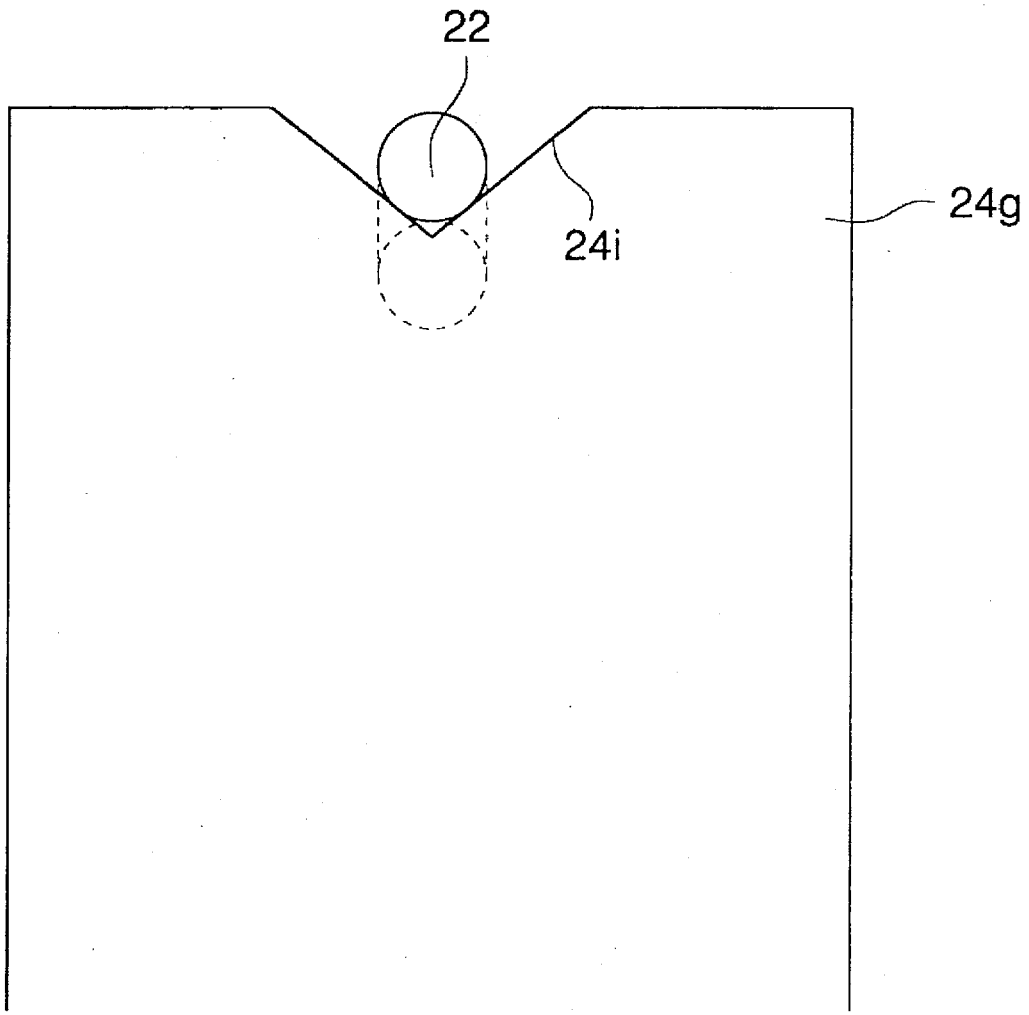
FIG. 4 is an enlarged view of a main portion of the first cleaning member of the present embodiment.

FIG. 4 is an enlarged view of the main portion of the first cleaning member 24*g*, viewed from the direction B in the drawing of the cleaning portion 24 in FIG. 3. The first cleaning member 24*g* will be described below, referring to FIG. 4.

As the first cleaning member 24*g*, it is preferable that the member 24*g* is made of a glass-contained resin as described below. This is because experiments by the present inventors show the following: other than the suitable pressure-contact force to press the first cleaning member to the corona charging electrode 22, the difference of relative hardness of the first cleaning member 24*g* with respect to the corona charging electrode 22 and foreign materials is an important factor to effectively scrape off the foreign materials without needlessly damaging the corona charging electrode 22. In the present embodiment, in order to obtain the suitable difference of hardness, glass filler is mixed into a resin material, for example, as described below.

In this connection, the Rockwell hardness used in this embodiment, is a value of the Rockwell hardness for plastic stipulated in JIS-K-7202, in which a steel ball is used as a pressure element; the depth of impression when a reference load (10 kgf) is applied is used as the reference; and after a test load (100 kgf or 60 kgf) is applied for a predetermined time, the depth of plastic impression is measured when the load is returned to the reference load, and the hardness is calculated according to a predetermined arithmetic formula. As a scale, the M scale and R scale are stipulated.

1. Glass filler is mixed into high anti-impact ABS resin at a rate of 20 to 40%.

R75 to 105 of the Rockwell hardness is typical of this ABS resin, and M65 to 100 is typical of the resin containing the glass filler.

2. Glass filler is mixed into polyester at a rate of 18%.

M98 of the Rockwell hardness is typical of this polyester, and M109 is typical of the resin containing the glass filler.

3. Glass filler is mixed into polycarbonate at a rate of 10 to 40%.

M73 to 78 of the Rockwell hardness is typical of this polycarbonate, and M88 to 95 is typical of the resin containing the glass filler.

4. Glass filler is mixed into polyacetal resin at a rate of 20%.

When the polyacetal resin is a homopolymer, M94 or R120 of the Rockwell hardness is typical of polyacetal resin, and when it is copolymer, M78 to 80 is typical of it. M75 to 90 is typical of the resin containing the glass filler.

As described above, a Rockwell hardness of not less than M60 is selected as the Rockwell hardness of the resin material and the glass filler, with a value not more than and close to the hardness of the material to be used for the corona charging electrode 22 as the upper limit, by considering the cleaning efficiency, which will be described later, under the conditions of the corona charging electrode 22, made of materials commonly used, and the pressure contacting force, which is introduced from a service life of the corona charging electrode 22. Specifically, the material, in which glass filler is mixed into the high anti-impact ABS resin at the rate of 20 to 40%, is preferable because of its low production cost.

When the first cleaning member **24*g* structured as described before, slides on the corona charging electrode 22, foreign materials adhered to the corona charging electrode 22 is scraped off, and even when the foreign materials firmly adheres to the electrode 22 in the form of layers, the foreign materials can be removed. Further, the resin material is worn out by sliding, and the corona charging electrode 22 erodes the first cleaning member 24*g* as shown by broken lines in FIG. 4. Accordingly, the contact surface of the corona charging electrode 22 with the first cleaning unit 24*g*** is increased, resulting in increased cleaning efficiency.

In addition to that, one pair of the first cleaning members **24*g* are structured so that the members 24*g* pressure-contact with the corona charging electrode 22 such that they are arranged opposite to each other at longitudinally different positions on the corona charging electrode 22 (refer to FIG. 3**(*b*) ). One pair of the first cleaning members **24*g* is always in contact with the corona charging electrode 22 under pressure even when wearing occurs, and therefore, the cleaning efficiency is assured by the increased contact surface. Further, decrease of the cleaning function for the foreign materials is prevented when compared to cases where the first cleaning members 24** are arranged directly opposite to each other such that two members collide with each other.

The shape of the contact pressure portion **24*i* of the first cleaning means 24*g*, which is in pressure-contact with the corona charging electrode 22, is almost V-shaped. Accordingly, positioning of the corona charging electrode 22 is limited by its valley portion. Even in the case of a cleaning operation in which the first cleaning member 24*g* slides in the direction of the length of the corona charging electrode 22, a damage or a break of the corona charging electrode 22 can be prevented without extreme change in tension of the stretched corona charging electrode 22**.

Next, the second cleaning member **24*h* will be described. It is preferable that the second cleaning member 24*h* is made of fibrous or porous material. This is for wiping off any powdered foreign materials which has been scraped off by the first cleaning member 24*g* and still adheres to the corona charging electrode 22**.

As a porous member, a foamed elastic body such as foamed silicon sponge, foamed rubber, etc., is selected. When this porous member slides on the corona charging electrode 22, the powdered foreign materials enters into numerous fine holes of the porous member and can be captured. As a fibrous member, felt or the like is selected. When the fibrous member slides on the corona charging electrode 22, powdered foreign materials is adhered among the numerous fine fibers on the surface in contact with the corona charging electrode 22, and can be captured in the same way as described above.

In the present embodiment, a foamed elastic body is selected as the second cleaning member **24*h*. This is because the foamed elastic body elastically deforms and encloses the periphery of the corona charging electrode 22**, resulting in an increase of cleaning efficiency.

Further, in the same way as the first cleaning body **24*g*, the second cleaning member 24*h* is also composed of one pair of the same members which are in pressure-contacted with the corona charging electrode 22, and are opposed to each other, at different positions on the length of the corona charging electrode 22 (refer to FIG. 3**(*b*) ). Accordingly, the pair of the second cleaning members **24*h* always pressure-contact with the corona charging electrode 22** with pressing force even when excessive wearing occurs, and therefore, a decrease of cleaning function of foreign materials is prevented.

As described above, since the first cleaning member **24*g* scrapes the foreign materials adhered to the corona charging electrode 22, and following that, the second cleaning member 24*h* wipes off the scraped foreign materials, the layered foreign materials firmly adhered on the corona charging electrode 22** is completely removed. Accordingly, image formation in an electrophotographic apparatus or the like is assuredly carried out, and image quality deterioration of the recorded image can be suppressed.

Further, sometimes, powdered foreign materials scraped by the first cleaning member **24*g* is accumulated between the pressure-contact portion 24*i* of the first cleaning member 24*g* and the corona charging electrode 22. When the second cleaning member 24*h* is provided near the outside portion in the direction of the length of the corona charging electrode 22 with respect to the first cleaning member 24*g*** as in the present embodiment, the above-described accumulated foreign materials can also be removed.

Figure 5:
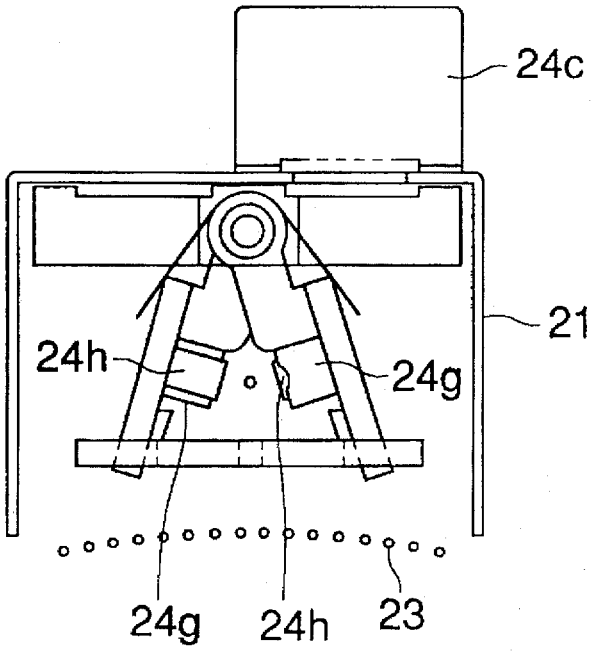
FIG. 5 is a view for explaining an open mechanism of the cleaning portion in the present embodiment.
Figure 5:
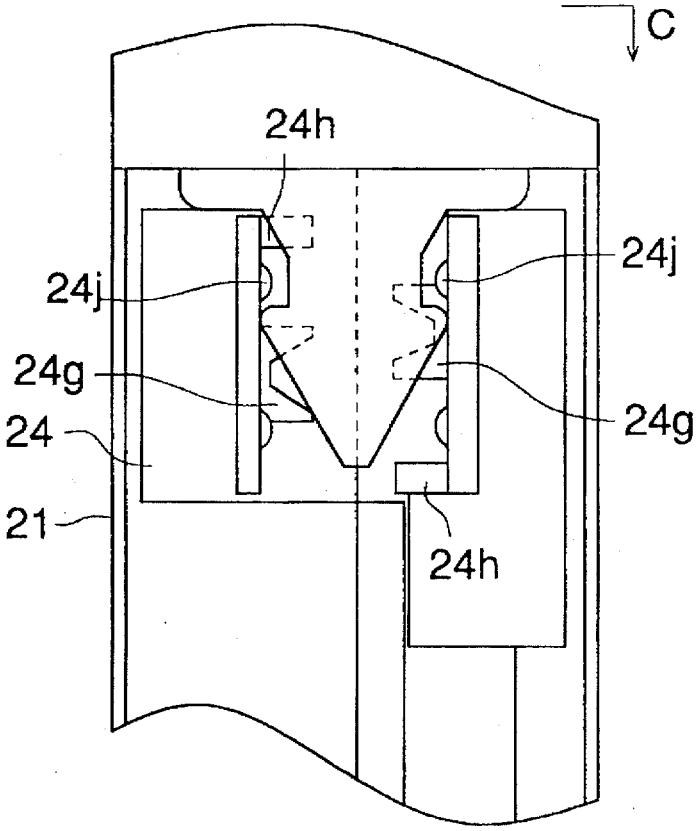

Next, referring to FIG. 2 and FIG. 5, an open mechanism of the cleaning portion 24 will be described.

An open member 26 is fixed at the right end portion of the charger 20 as an open means. This open member 26 is formed in an arrow-shape which points to a gap formed between a pair of cleaning member holders **24*e***.

In the case where the operator has completed the cleaning operation of the corona charging electrode 22, by grasping the knob portion **24*c* and moving the cleaning portion 24 toward the right end portion of the charger 20, the tip of the arrow of the open member comes into contact with latch portions 24*j* which are respectively provided on one pair of cleaning member holders 24*e*. When the cleaning portion 24** is moved farther, one pair of cleaning member holders 24*e* are opened against the pressing force of the coil spring 24*f*. When the end portion of the arrow of the open member 26 has passed through the latch portions 24*j*, the end portion of the arrow is engaged with the latch portions 24*j* and the open member 26 cannot freely remove from the cleaning portion 24.

Due to such open mechanism, the pressure-contact condition of the first cleaning member 24*g* and the second cleaning member 24*h* with respect to the corona charging electrode 22 is released. Accordingly, undesired oscillation of the corona charging electrode 22 in the direction perpendicular to its length, i.e. the direction of pressure-contact, is prevented, and appropriate charging function is assured when the charger 20 carries out ordinary corona charging for image formation.

In cases where the operator again carries out cleaning operations, when he grasps the knob portion 24*c* of the cleaning portion 24 and moves it to the left side of the charger 20, then the engagement of the latch portions with the end portion of the arrow-shaped portion of the open member 26 is automatically released, and therefore, the cleaning operation proceeds smoothly.

After the cleaning operation has been carried out as described above, the corona charging electrode 22 is used for charging the photoreceptor drum 1.

Although, in the present embodiment, a case in which the present invention is applied to the charger of color printers, is explained, it can also be applied to monochromatic printers, and the same effects are obtained.

Further, although the case where the present invention is applied to a scorotron charger provided with a grid, is explained, the same effects can also be obtained with a corotron charger in which no grid is provided.

Further, the same effects are also obtained in cases where the corona charge is used for transferring, charging, or separation, other than the charging.

Still further, when the charger 20 is mounted in a detachable process cartridge in which the photoreceptor drum 1, developing unit 4 and a toner container to replenish toner as necessary are integrally structured, without fixing the charger 20 inside the apparatus which is barely accessible at the time of cleaning, then, the cleaning operation can be easily carried out and its convenience is increased, if the process cartridge can be removed from the apparatus.

As described above, according to the present invention, since the first cleaning means scrapes off the foreign materials adhered to the corona charging electrode, and following that, the second cleaning means wipes out the scraped foreign materials, the layered foreign materials firmly adhered on the corona charging electrode 22 is totally removed. Accordingly, image formation in electrophotographic apparatus or the like is suitably carried out, and deterioration of recorded image quality can be suppressed.

Further, according to the invention, glass material contained in resin material has suitable hardness and effectively scrapes off foreign materials adhered to the corona charging electrode, and such cleaning means can be produced at low cost.

Still further, according to the present invention, powdered foreign materials can be almost entirely captured by the fibrous or porous second cleaning means.

Furthermore, since the cleaning means are in pressure-contact with the corona charging electrode at different positions along its length, a decrease of cleaning function for the foreign materials is prevented. Further, since the cleaning means are arranged in opposite to each other, sandwiching the corona charging electrode between them, these means can clean different both side portions of the surface of the corona charging electrode.

Further, since the pressure-contact condition of the cleaning means with the corona charging electrode is released by an open means except during the time of cleaning, suitable charging function can be assured.

What is claimed is:

1. A corona generating apparatus for use in an electrophotographic copy machine, said apparatus comprising:

(a) an electrode wire for charging corona therefrom;

(b) a scraping device for scraping said electrode wire so that foreign materials adhering to said electrode wire are scraped therefrom;

(c) a wiping device for wiping said electrode wire so that said foreign materials scraped from said electrode wire by said scraping device are removed therefrom;

(d) a holding device for holding said scraping device and said wiping device; and (e) a supporting device for supporting said holding device so as to shift said holding device along said electrode wire.

2. The corona generating apparatus of claim 1, wherein said scraping device comprises a resin including fiberglass.

3. The corona generating apparatus of claim 1, wherein said wiping device comprises at least one of a fibrous material and a porous material.

4. The corona generating apparatus of claim 2, wherein said wiping device comprises at least one of a fibrous material and a porous material.

5. The corona generating apparatus of claim 1, wherein said scraping device includes a first and second scraping members, said wiping device includes a first and second wiping members, and said holding device includes a first and second holding members, and wherein said first scraping member and said first wiping member are provided on the first holding member, said second scraping member and said second wiping member provided on the second holding member, and said first and second holding members nip said electrode wire therebetween.

6. The corona generating apparatus of claim 1, further comprising a releasing means for releasing said scraping device and said wiping device from said electrode wire.

7. The corona generating apparatus of claim 5, further comprising a releasing device for releasing said first and second scraping member and said first and second wiping members so as to open said nipping of said first and second holding members.

* * * * *